US005829365A

United States Patent [19]

Cheng et al.

[11] Patent Number: 5,829,365

[45] Date of Patent: Nov. 3, 1998

[54] LEG STRUCTURE FOR A FOLDING TABLE

[76] Inventors: Kuo-Tai Cheng; Kuo-Pen Cheng, both of 1st Floor, No. 2, Lane 226, Tiao Ho Street, Keelung, Taiwan

[21] Appl. No.: 902,981

[22] Filed: Jul. 30, 1997

[51] Int. Cl.[6] ..... A47B 3/02

[52] U.S. Cl. ..... 108/118; 108/131

[58] Field of Search ..... 108/118, 115, 108/131; 248/309.4, 166, 439, 188.6, 434

[56] References Cited

U.S. PATENT DOCUMENTS

| | | | |
|---|---|---|---|
| 2,471,564 | 5/1949 | Gaudette | 108/118 |
| 2,727,564 | 12/1955 | Gruber | 108/118 X |
| 3,646,895 | 3/1972 | Campbell | 108/118 |
| 4,386,677 | 6/1983 | Gulezian | 108/118 X |
| 5,335,604 | 8/1994 | Jiang | 108/118 X |

FOREIGN PATENT DOCUMENTS

| | | | |
|---|---|---|---|
| 268660 | 2/1965 | Australia | 108/118 |
| 2498904 | 8/1982 | France | 108/118 |

*Primary Examiner*—Jose V. Chen
*Attorney, Agent, or Firm*—W. Wayne Liauh

[57] ABSTRACT

Disclosed is a leg structure for a folding table which prevents a small child from being dangerously clamped by the table legs when the table tilts over and the legs become folded to a table top of the table. The table legs include a first leg pair having two integrally formed legs and a second leg pair formed of a U-shape upper frame, a middle connecting frame, and a lower leg frame. Upper ends of the integrally formed legs and the U-shaped upper frame are pivotally connected to a bottom side of the table top. The lower leg frame is pivotally connected to the integrally formed legs. The middle connecting frame is pivotally connected at upper ends to the U-shaped upper frame and at lower ends to the lower leg frame. When the two leg pairs are extended from the table top, the middle connecting frame abuts against a lower crossbar on the U-shaped upper frame and an upper crossbar on the lower leg frame to define a maximum open angle to which the two leg pairs can be extended relative to one another.

2 Claims, 9 Drawing Sheets

LEG STRUCTURE FOR A FOLDING TABLE

BACKGROUND OF THE INVENTION

The present invention relates to a leg structure for a folding table, and more particularly to a safe leg structure for a folding table that prevents small children from being dangerously clamped between and thereby seriously injured or even killed by folded legs when the table unexpectedly tilts over.

A folding table is widely welcomed by consumers because it is light in weight and can be folded for convenient storage without occupying too much space. Please refer to FIG. 1 in which a conventional folding table 10 is shown. The table 10 includes a table top 11 and two pairs of legs 12, 13 pivotally connected to one another near their middle points, so that the two pairs of legs 12, 13 may be extended or folded relative to one another. Wherein, the pair of legs 13 is formed from an upper part 14 and a lower part 15. The upper part 14 is a U-shaped member with two upper ends fixed to a bottom side of the table top 11. A crossbar of the U-shaped upper part member 14 is provided at an inner side with a downward projected plate 16. When the upper part 14 of the pair of legs 13 is pivotally pulled outward relative to the table top 11, the projected plate 16 shall finally touch and be stopped by a crossbar 17 transversely extending between two legs forming the lower part 15. This means that the pair of legs 13 have been extended to a maximum open angle relative to the table top 11. Meanwhile, the other pair of legs 12 are also brought by the fully extended legs 13 to a maximum open angle relative to the legs 13. At this point, the table 10 with two pairs of fully extended legs can stand stably for use. When the table 10 is in its fully extended position to stand stably, the two pairs of legs 12, 13 are subjected to an outward pressure determined by the maximum angle to which one of the pair of legs can be extended relative to the table top 11.

The conventional folding table 10 can be easily operated to a standing position. However, the legs 12, 13 which are constructed in the above-mentioned manner shall dangerously cause a small child to be clamped between the two pairs of legs when the table 10 unexpectedly tilts over. Please refer to FIG. 2 which generally illustrates a small child's body 31 being clamped between the legs 12, the upper part 14 of the legs 13, and the table top 11 when the table 10 tilts over. While the body 31 exerts a downward force to the legs 12, the lower part 15 of the legs 13 moves downward due to the force of gravity. This causes the two pairs of legs 12, 13 to fold toward one another and toward the table top 11, and therefore tightly clamp the body 31 between them. There are records that small children are killed and/or seriously injured under this condition. There are also victims as old as thirteen or fourteen. When the small child being clamped between the folded legs attempts to struggle through the folded table legs 12, 13, the moving body 31 shall exert even larger force on the legs below the body 31 and causes the legs to fold even close to one another and more tightly clamp the body 31 between them. Even if there are other children near the tilted table 10, it is difficult for them to help the clamped child out of the folded table legs. Due to such potential dangers existing in the conventional folding tables, this type of folding tables are rejected by many furniture firms.

It is therefore tried by the inventor to develop a safe leg structure for folding tables to eliminate the drawbacks found in the conventional folding tables.

SUMMARY OF THE INVENTION

A primary object of the present invention is to provide a table with a safe folding leg structure. When the table unexpectedly tilts over and there is someone being clamped between the table legs, the table legs will not become completely folded due to any pressure applied on them by the clamped person struggling through the tilted table.

The folding table according to the present invention mainly includes a table top, a first leg pair including two integrally formed legs, and a second leg pair formed from three sequentially pivotally connected parts, namely, a U-shaped upper frame, a middle connecting frame, and a lower leg frame. Upper ends of the integrally formed legs and the U-shaped upper frame are pivotally connected to a bottom side of the table top. The lower leg frame is pivotally connected to the integrally formed legs. The middle connecting frame is pivotally connected at upper ends to the U-shaped upper frame and at lower ends to the lower leg frame. When the two leg pairs are extended from the table top, the middle connecting frame abuts against a lower crossbar on the U-shaped upper frame and an upper crossbar on the lower leg frame to define a maximum open angle to which the two leg pairs can be extended relative to one another. When the table tilts over and there is someone being clamped between the table legs, the table top and/or the U-shaped upper frame of the second leg pair can be easily pushed outward to release the clamped person from the partially folded table legs.

BRIEF DESCRIPTION OF THE DRAWINGS

The structure and the function of the present invention can be best understood by referring to the following detailed description of the preferred embodiment and the accompanying drawings, wherein.

DETAILED DESCRIPTION OF THE PREFERRED EMBODIMENT

Figure 1:
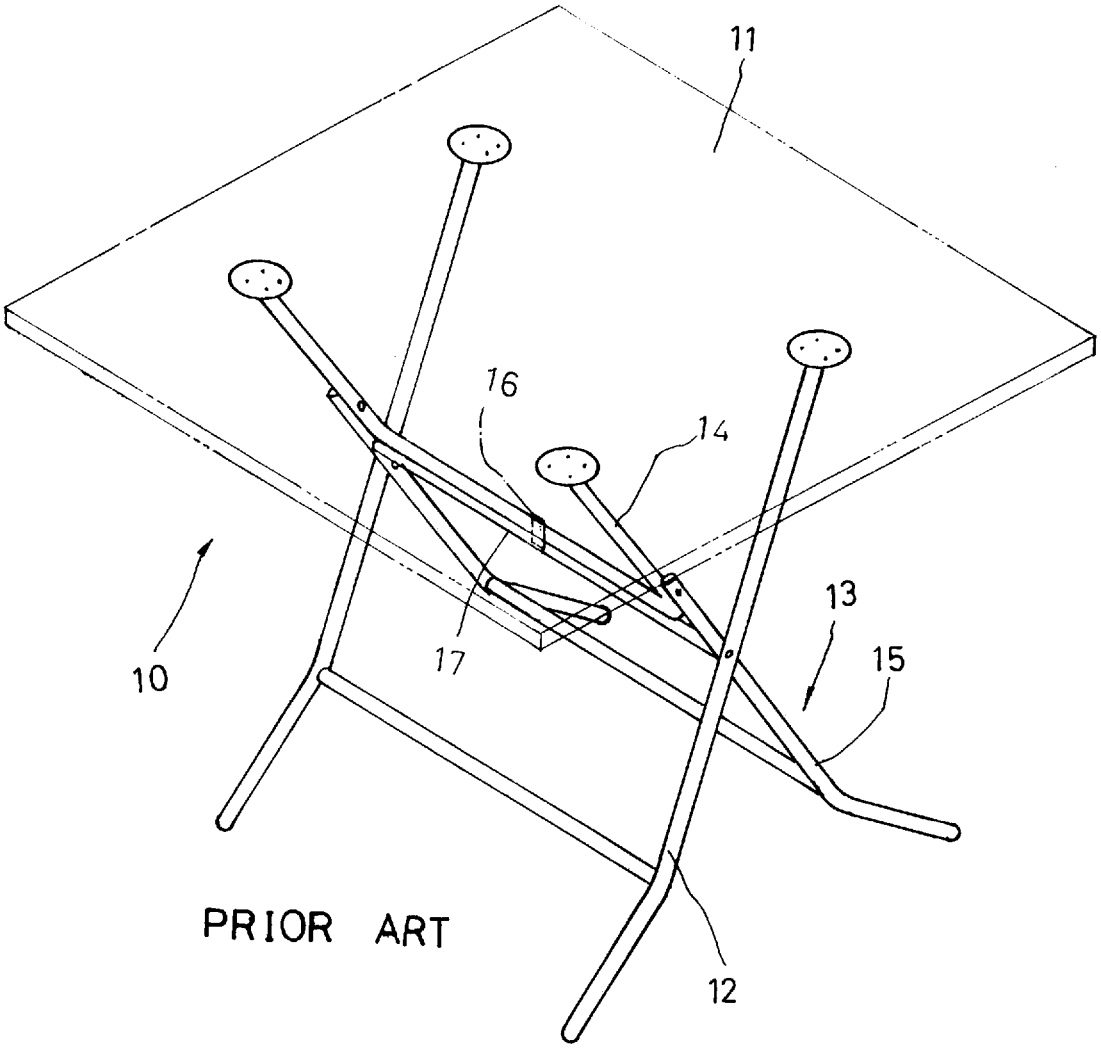
FIG. 1 is a perspective showing the leg structure of a conventional folding table.
Figure 2:
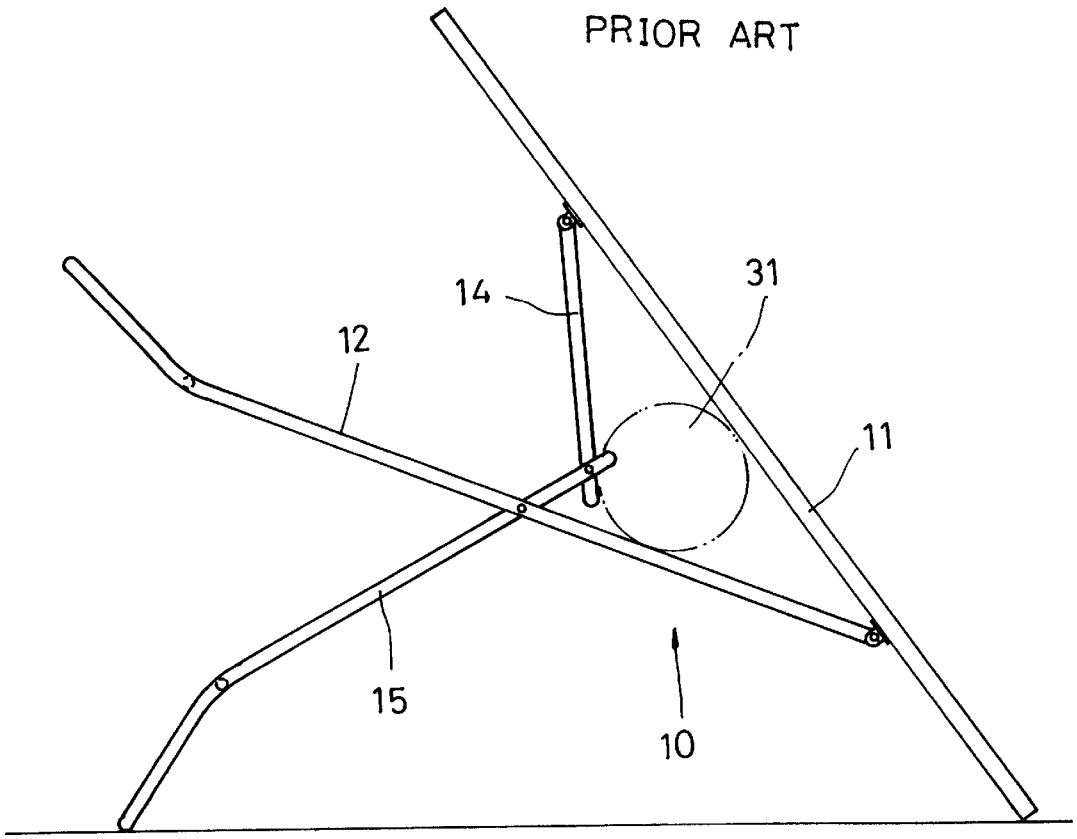
FIG. 2 schematically illustrates the condition in which a tilted conventional folding table clamps a small child between the folded legs.
Figure 3:
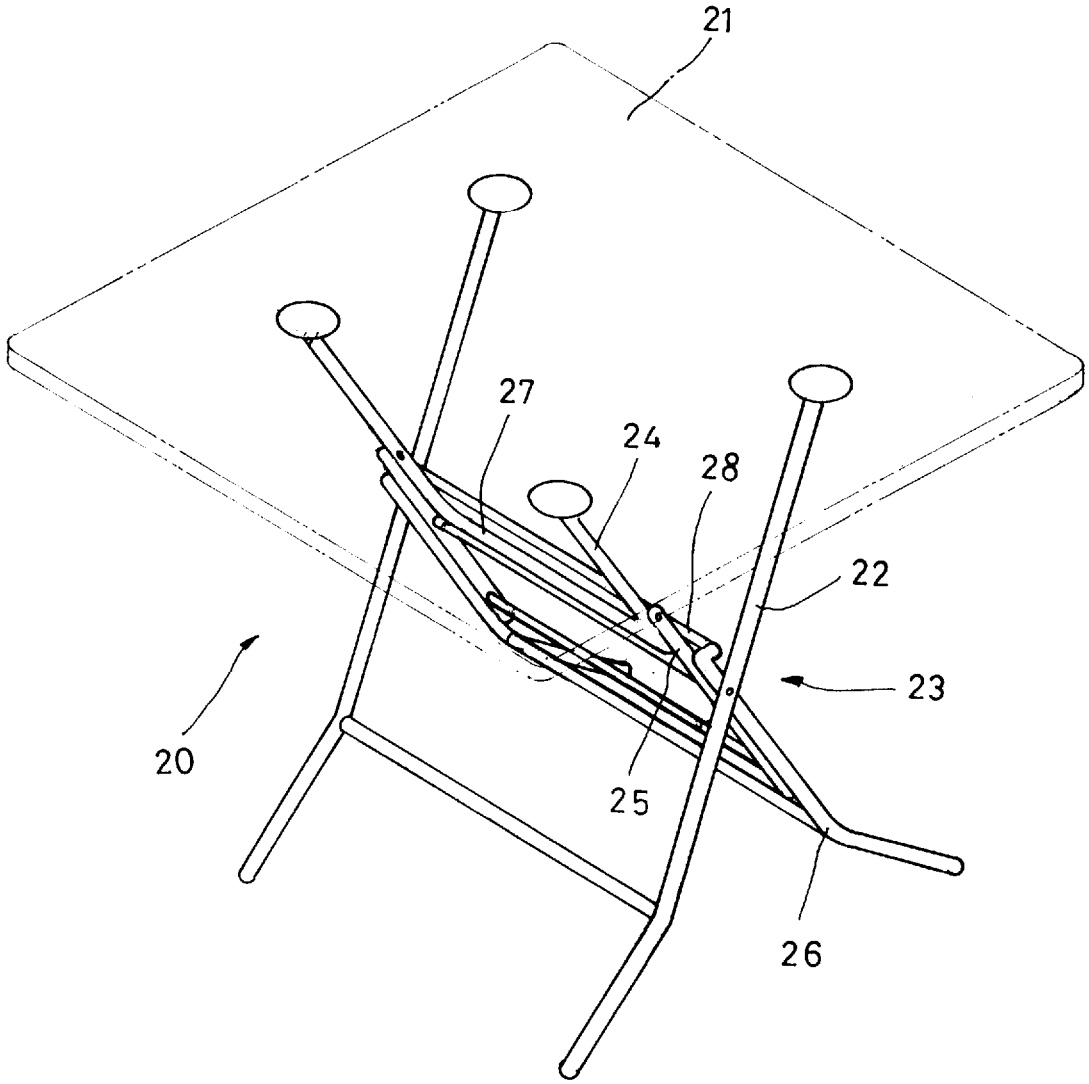
FIG. 3 is a perspective showing the safe leg structure of a folding table according to the present invention in a fully extended state.
Figure 5:
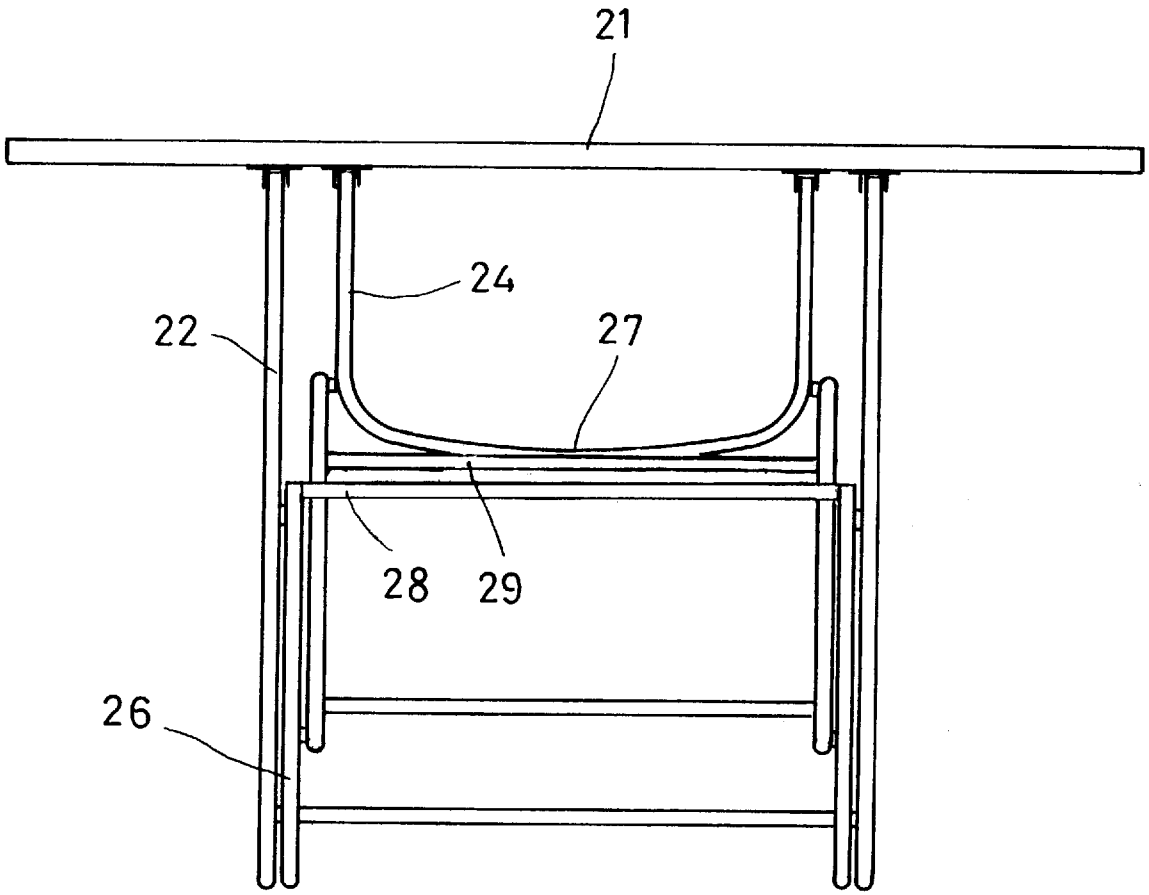
FIG. 5 is front elevational view of the folding table shown in FIG. 3.

Please refer to FIGS. 3 and 5. The present invention relates to a leg structure for a folding table. The folding table 20 includes a table top 21 and two pairs of legs 22 and 23. The leg pair 22 includes two integrally formed legs having two upper ends pivotally connected to a bottom side of the table top 21. Another leg pair 23 is formed from three parts, namely, a U-shaped upper frame 24, a middle connecting frame 25, and a lower leg frame 26. The U-shaped upper frame 24 has two upper ends pivotally connected to the bottom side of the table top 21. The lower leg frame 26 has two upper ends separately pivotally connected to the two integrally formed legs 22. The middle connecting frame 25 has a width slightly larger than that of the U-shaped upper frame 24 but slightly smaller than that of the lower leg frame 26. The middle connecting frame 25 has two upper ends separately pivotally connected to two outer sides of the U-shaped upper frame 24 at points higher than a lower crossbar 27 of the frame 24 and two lower ends to two inner sides of the lower leg frame 26 at points lower than an upper crossbar 28 of the leg frame 26. When the three-part leg pair 23 is extended, the middle connecting frame 25 shall abut against the lower crossbar 27 of the U-shaped upper frame 24 and the upper crossbar 28 of the lower leg frame 26 and therefore stops the upper and the lower frames 24, 26 from overextended. In other words, the middle frame 25 defines a maximum open angle for the leg pair 23 as well as for the leg pair 22. When the two pairs of legs 22, 23 are in their fully extended position, the folding table 20 is allowed to stably stand.

The lower leg frame 26 of the three-part leg pair 23 is pivotally connected to the integrally formed leg pair 22. As a result, when the leg pair 23 is set to its maximum open angle, the leg pair 22 is also brought to its maximum open angle to allow the table 20 to successfully and smoothly extend and stably stand, as shown in FIG. 3.

Figure 6:
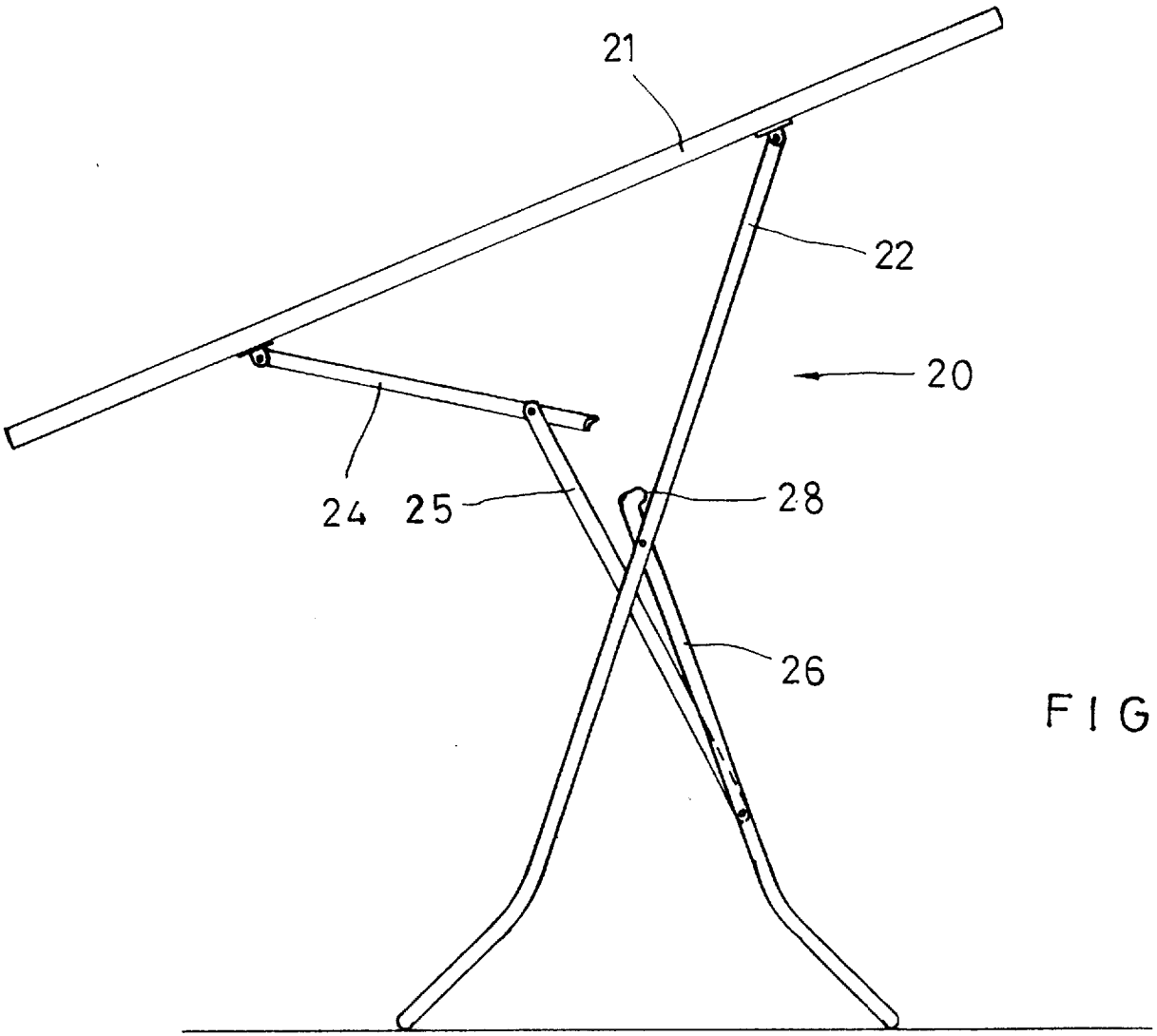
FIG. 6 is a side view showing the manner in which the legs of the present invention are folded.
Figure 7:
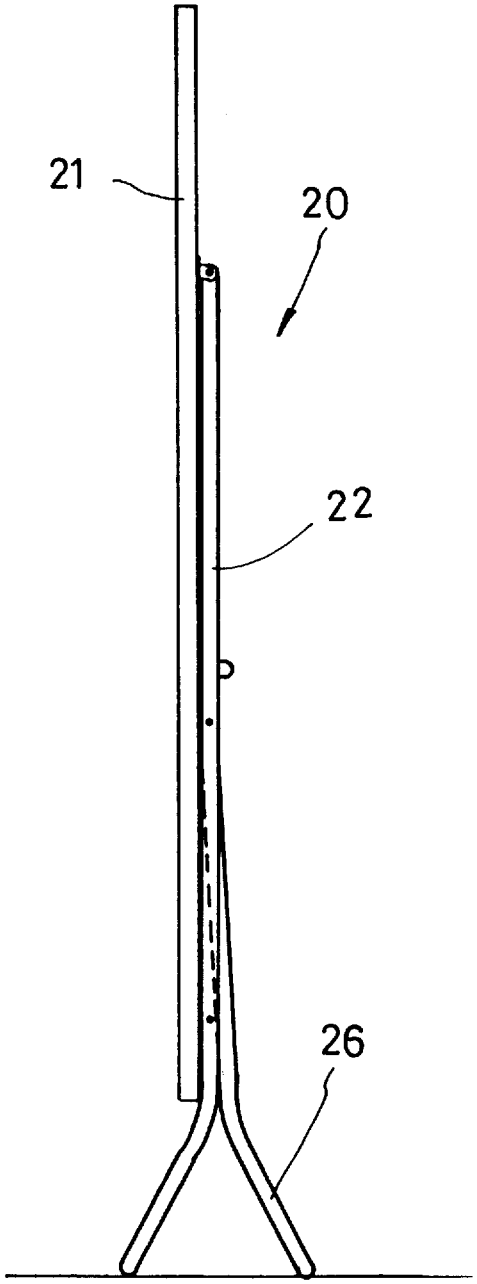
FIG. 7 is a side view showing the folding table of the present invention in a fully folded state.

To fold the pairs of legs 22, 23 to the table top 21, first push against the lower crossbar 27 of the U-shaped upper frame 24 of the three-part leg pair 23, and then apply a downward minor force on the table top 21 at a portion near the U-shaped upper frame 24, as shown in FIG. 6. Keep pushing the table top 21 downward until the whole table 20 is in a completely folded state, as shown in FIG. 7.

Figure 8:
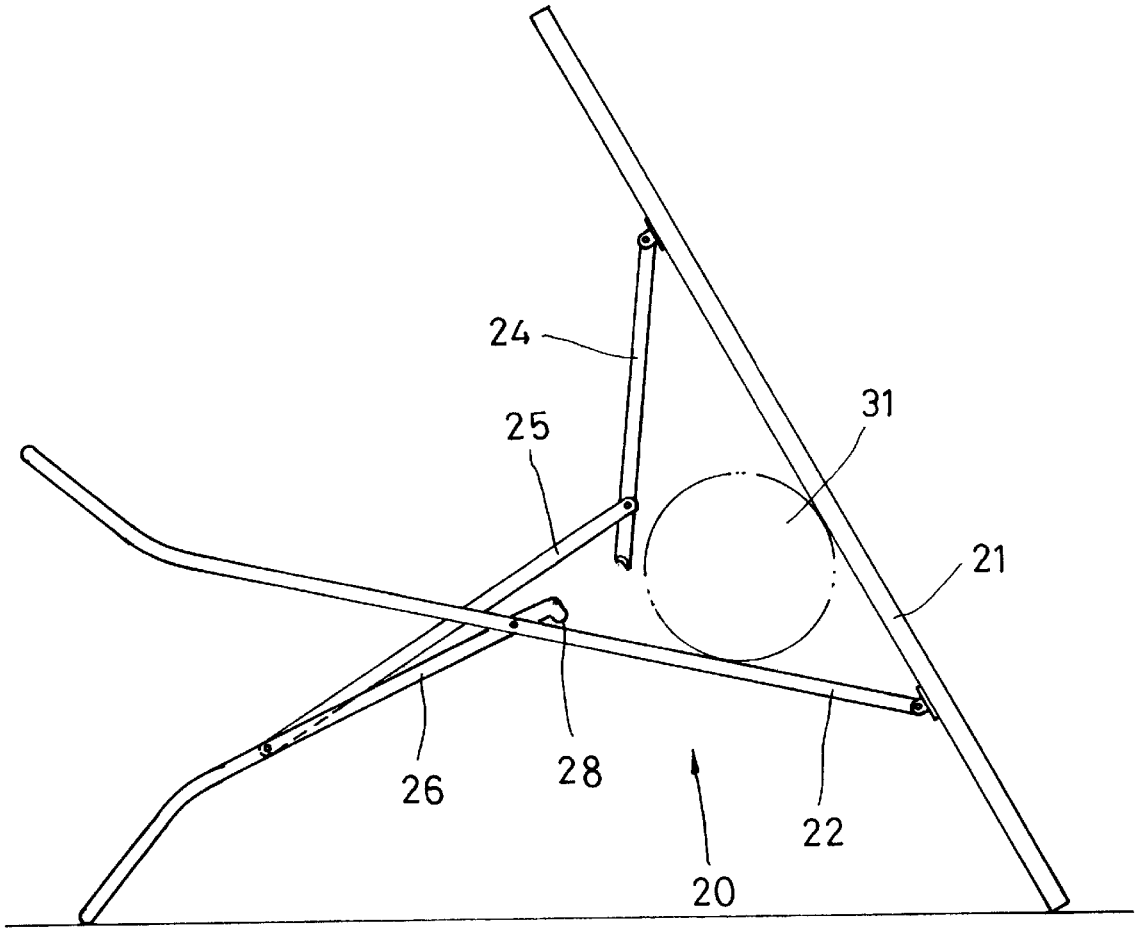
FIG. 8 schematically illustrates the condition in which a small child is clamped between the legs of a tilted folding table according to the present invention.
Figure 9:
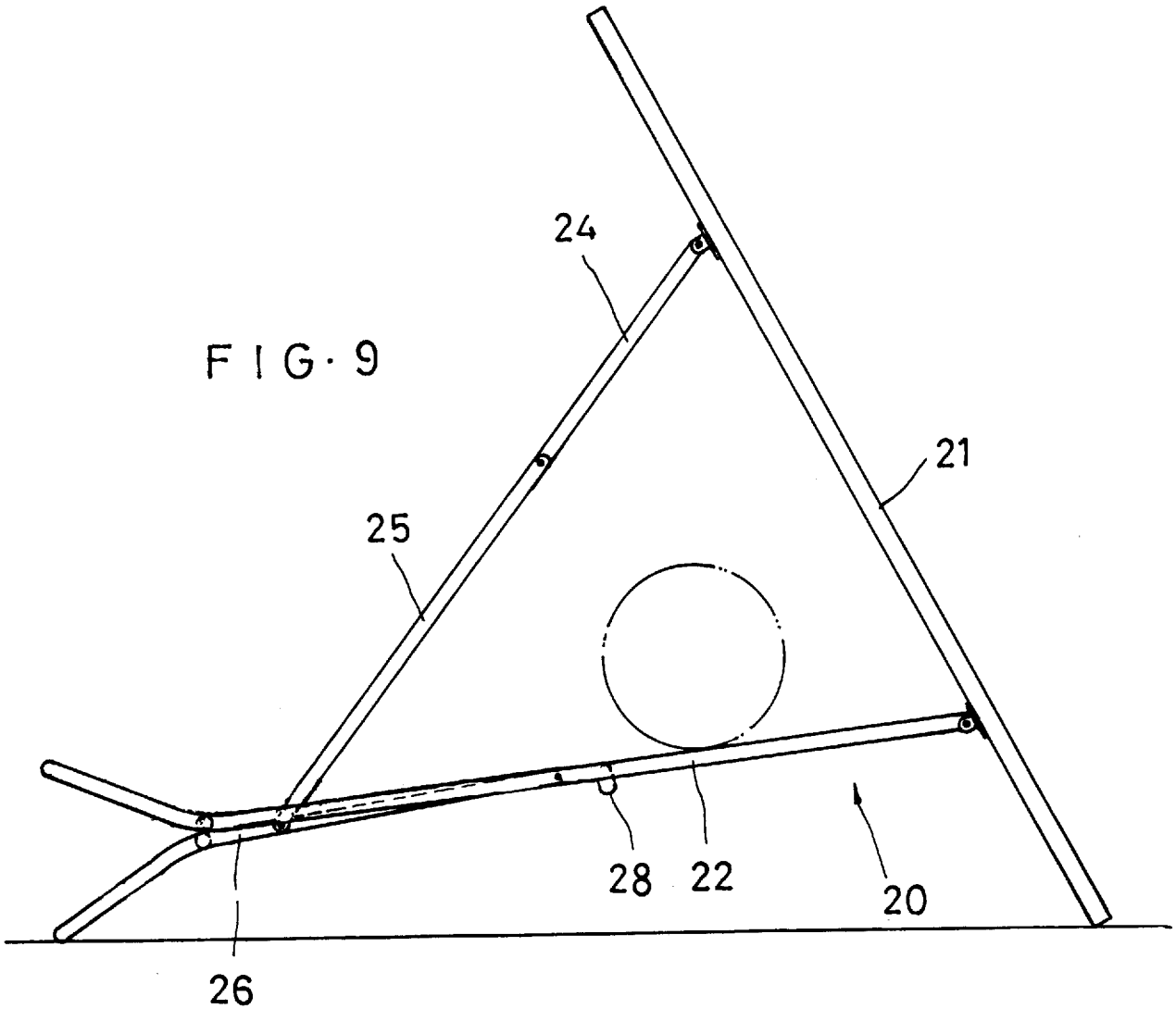
FIG. 9 schematically illustrates the condition of the legs of the tilted folding table when the small child clamped therebetween attempts to get out of the folded legs.

In the event the folding table of the present invention unexpectedly tilts over and unfortunately clamps a small child's body 31 between its folded legs, as shown in FIG. 8, a force applied by the child's body 31 on the integrally formed leg pair 22 below the body will not cause the three-part leg pair 23 to fold. Instead, the pressure from the child's body will only cause the lower leg frame 26 of the three-part leg pair 23 to fold to the integrally formed leg pair 22, while the U-shaped upper frame 24 and the middle connecting frame 25 of the three-part leg pair 23 are pushed outward to an angle the same as the open angle of the legs when the table 20 was stably stand, as shown in FIG. 9. Even if the child is struggling against the legs clamping him or her, the legs of the table would not be collapsed to clamp the child even tighter. On the contrary, the table top 21 will be raised by the struggling child and causes the U-shaped upper frame 24 of the leg pair 23 to move away from the child, allowing the child to get out of the leg pairs 22, 23 that originally clamp him or her.

Figure 10:
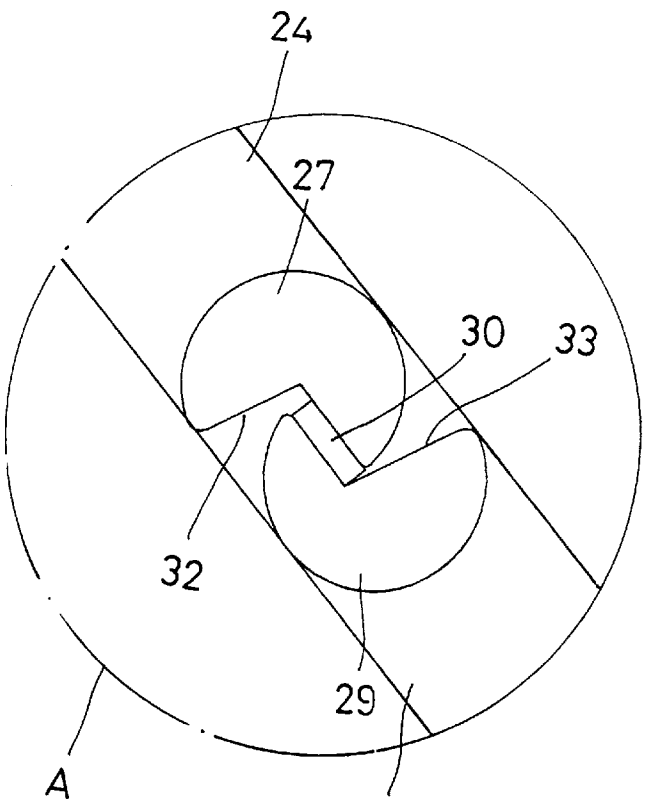
FIG. 10 is an enlarged side sectional view taken on the area A in FIG. 4.
Figure 4:
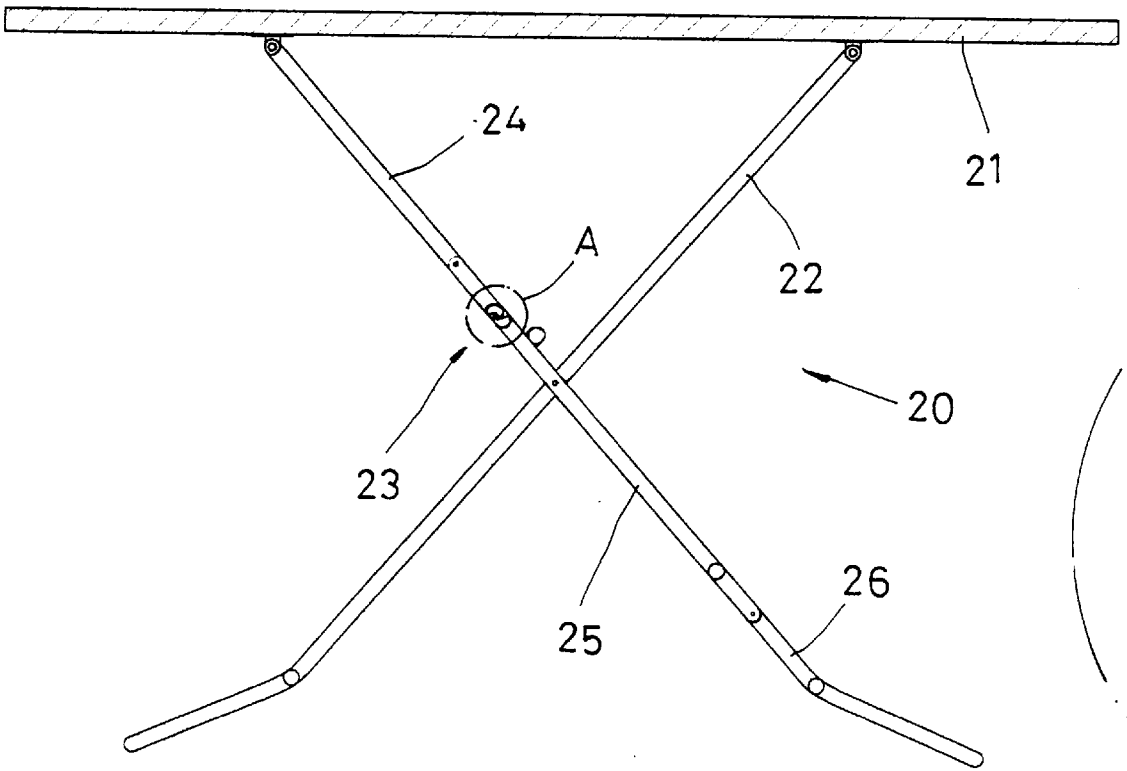
FIG. 4 is a side view of the folding table of FIG. 3.

Please refer to FIGS. 4 and 10. An upper crossbar 29 of the middle connecting frame 25 of the three-part leg pair 23 and the lower crossbar 27 of the U-shaped upper frame 24 are formed at their contact areas respectively with a notch 33, 32, as can be clearly seen from FIG. 10. These notches 33, 32 allow the crossbars 29 and 27 to fitly abut against one another at these particular notched portions without moving any further. That is, these notches 33, 32 allow the middle connecting frame 25 and the U-shaped upper frame 24 to align with one another in the same plane when the leg pairs 22, 23 are in their fully extended position. A magnet 30 can be fixedly attached to the crossbar 29 of the middle connecting frame 25 at a central point thereof, so as to enhance the fitly contact of the middle connecting frame 25 with the U-shaped upper frame 24. In the event the folding table 20 tilts over, a magnetic attraction provided by the magnet 30 between the crossbar 27 and the crossbar 29 shall prevent the U-shaped upper frame 24 from loosely dropping downward due to gravity. That is, the U-shaped upper frame 24 and the middle connecting frame 25 will maintain an extended state as shown in FIG. 9 without the possibility to injure a small child who happens to be there and be clamped between the two pairs of legs 22, 23.

With the above arrangements, the leg structure for a folding table of the present invention allows the table not only to be easily folded and extended but also to be used in a safe manner. A small child unexpectedly clamped between table legs when the table tilts over may still safely struggle through or be saved from the tilted table.

What is claimed is:

1. A leg structure for a folding table, comprising a table top, a first leg pair including two integrally formed legs, and a second leg pair formed from a U-shaped upper frame, a middle connecting frame, and a lower leg frame;

said first leg pair having two upper ends pivotally connected to a bottom side of said table top;

said U-shaped upper frame having two top ends pivotally connected to the bottom side of said table top, said U-shaped upper frame also having a upper crossbar and a lower crossbar, said lower leg frame having two upper ends pivotally connected to said two integrally formed legs, respectively, and said middle connecting frame having a width slightly larger than that of said U-shaped upper frame but slightly smaller than that of said lower leg frame;

said middle connecting frame having two upper ends pivotally connected to two outer sides, respectively, of said U-shaped upper frame at points higher than said lower crossbar of said U-shaped upper frame, and two lower ends pivotally connected to two inner sides, respectively, of said lower leg frame at points lower than said upper crossbar of said leg frame, such that when said second leg pair is fully extended, said middle connecting frame abuts against, and is thus stopped by, both said lower crossbar and said upper cross bar so as to prevent said second leg pair from being overextended.

2. A leg structure for a folding table as claimed in claim 1, wherein:

said middle connecting frame having an upper crossbar in contact with said lower crossbar of said U-shaped upper frame, and two notches being respectively formed on said upper crossbar of said middle connecting frame and said lower crossbar of said U-shaped upper frame at areas where said two crossbars contacting with one another to allow said two crossbars to fitly abut against each other at said two notches without moving any further, and wherein a magnet is fixedly attached to said notch on said crossbar of said middle connecting frame, so as to enhance a contact between said middle connecting frame and said U-shaped upper frame.

* * * * *